US008087097B2

(12) United States Patent
Maier

(10) Patent No.: US 8,087,097 B2
(45) Date of Patent: Jan. 3, 2012

(54) PROTECTION PAD FOR CYCLIST TROUSERS AND RELATIVE METHOD OF REALIZATION

(75) Inventor: Roger Maier, Carona (CH)

(73) Assignee: ASSOS of Switzerland S.A. (CH)

( * ) Notice: Subject to any disclaimer, the term of this patent is extended or adjusted under 35 U.S.C. 154(b) by 799 days.

(21) Appl. No.: 12/048,799

(22) Filed: Mar. 14, 2008

(65) Prior Publication Data

US 2008/0229486 A1 Sep. 25, 2008

(30) Foreign Application Priority Data

Mar. 23, 2007 (EP) ..... 07006049
Nov. 2, 2007 (EP) ..... 07021407

(51) Int. Cl.
*A41D 13/00* (2006.01)

(52) U.S. Cl. ..... 2/227

(58) Field of Classification Search ..... 2/227, 79, 2/267, 455, 228, 238, 98–99; 450/400–408; 5/653; 297/195.1, 195.13, 200–202, 213, 297/214

See application file for complete search history.

(56) References Cited

U.S. PATENT DOCUMENTS

| | | | | |
|---|---|---|---|---|
| 4,961,233 | A * | 10/1990 | Black | 2/228 |
| 5,267,354 | A * | 12/1993 | Grilliot et al. | 2/23 |
| 5,271,101 | A | 12/1993 | Speth et al. | |
| 5,514,104 | A * | 5/1996 | Cole et al. | 604/366 |
| 5,978,970 | A | 11/1999 | Bright | |
| 6,687,917 | B2 * | 2/2004 | Forsyth et al. | 2/228 |
| 6,928,665 | B1 * | 8/2005 | Yates | 2/466 |
| 6,990,693 | B2 * | 1/2006 | Reschewitz | 2/228 |
| 2002/0029409 | A1 | 3/2002 | Coccia | |
| 2003/0131399 | A1 | 7/2003 | Forsyth et al. | |
| 2005/0210570 | A1 | 9/2005 | Garneau | |
| 2006/0277662 | A1 | 12/2006 | Coccia | |

FOREIGN PATENT DOCUMENTS

| | | | |
|---|---|---|---|
| DE | 20211311 | U1 | 12/2003 |
| EP | 0776615 | A2 | 6/1997 |
| EP | 1269873 | A | 1/2003 |
| EP | 1405574 | A2 | 4/2004 |
| EP | 1430797 | A2 | 6/2004 |
| FR | 2828634 | A1 | 2/2003 |

* cited by examiner

*Primary Examiner* — Tejash Patel
(74) *Attorney, Agent, or Firm* — Akerman Senterfitt

(57) ABSTRACT

A protection seat (10, 110) for the crotch area (14) of cyclist trousers (12), having at least a front portion (16, 116) and preferably also a rear portion (118) formed with an anatomical concave shell shape. A method for manufacturing the seat is also described wherein said concave regions are obtained by joining the flaps of V notches cut in the front and rear portion of the seat.

15 Claims, 6 Drawing Sheets

PROTECTION PAD FOR CYCLIST TROUSERS AND RELATIVE METHOD OF REALIZATION

FIELD OF THE INVENTION

The present invention refers, in its most general aspect, to the technical field of skin-tight sports clothing or trousers for cycling. The invention refers in particular to a protection seat for cyclist trousers and to a method for making such a seat.

In this specification, the term cyclist trousers is directed to any clothing used in the sport of cycling, like for example shorts or long trousers, overalls, tights body suit and similar. The term seat is used to identify the shaped pad that is associated with the trousers or formed in the trousers themselves, to protect the perineal area of the body, in contact with the bicycle saddle.

PRIOR ART

In the field of manufacture of cyclist trousers, the seat is a crucial component for protection of the perineal and/or ischiatic parts of the body, which are in contact with the bicycle saddle and subject to pain during intensive use. According to the prior art, the seat generally consists of a plurality of layers of soft materials, capable of damping bumps and fatigue stresses, and fabric layers in contact with the skin.

A protection seat, according to known art, is associated to the crotch area of a cyclist trousers and comprises a front pubic portion and a perineal-ischiatic rear portion. Said front portion is intended for protection of the pubic area of a cyclist wearing a cyclist trousers fitted with the above protection seat, and said rear portion is intended for protection of the perineal and ischiatic area of the cyclist.

Although advantageous from various points of view, the seats currently used are unable to offer sufficient protection to some particularly delicate body parts and a satisfactory degree of general comfort. These drawbacks are also due to the fact that the movements and the muscular stresses are not symmetrical, but are 180° out of phase in accordance with the pedaling movement.

EP-A-0776615 discloses trousers for cyclist with a seat or insert, wherein the insert has incisions so that sewing the insert into the trousers has the effect that the insert assumes a three-dimensional shape hugging the body of the cyclist.

SUMMARY OF THE INVENTION

The problem forming the basis of the present invention is to devise and provide a protection seat for cyclist trousers, having structural and functional characteristics such as to overcome the above drawbacks. In particular, the problem underlying the invention is to improve known cyclist trousers obtaining better comfort and protection to delicate body parts during the use.

This problem is solved with a protection seat for the crotch area of a cyclist trousers, the seat comprising, in a single piece, a front pubic portion and a perineal-ischiatic rear portion, wherein at least the front portion is formed with a concave shell shape.

According to a further aspect of the invention, both the front portion and the rear portion of the seat are formed with a concave shell shape.

In a preferred embodiment, the concave shell shape of the front portion and, if provided, the concave shell shape of the rear portion of the seat are obtained, respectively, with joints of longitudinal median notches of the seat. More preferably, length of said joints is between about one quarter and about one third of the length of the seat itself.

According to another aspect of the invention, the front portion of the seat is shaped and sized to receive at least a part of the male genital organs of the cyclist wearing the trousers. Preferably, said front portion of the seat is anatomically shaped to shield and support the male genitals, in particular the scrotal area. In a preferred embodiment the concave front portion is sized and limited to front areas of the seat that are not subject to the tensions due to the pedaling movement.

The concave shell-shape of the rear part is suitable for making the garment more anatomical and wearable as a whole, and for making it more comfortable to sit on the saddle.

In accordance with a preferred embodiment, the rear portion of the seat is equipped with at least a pair of shaped pads, equally spaced apart and mirroring one another, i.e. symmetrical, with respect to a median longitudinal line of the seat.

An object of the invention is also a method for manufacturing and pre-forming a protection seat for cyclist trousers, characterized in that it comprises at least the steps of:

- shaping the seat with a front portion and a rear portion;
- making a notch on said front portion, the notch being longitudinal, median and substantially V-shaped with an open end, obtaining two opposite flaps;
- joining at least a portion of the opposite flaps of said notch, obtaining a longitudinal joint and forming a shell-shaped concave region in said front portion of the seat.

The process may further provide the step of making a further longitudinal, median V-shaped notch open at the end on the rear portion of the seat, obtaining two further opposite flaps, and joining at least a portion of said further opposite flaps obtaining a rear longitudinal joint and thus forming a shell-shaped concave region also in the rear portion of the seat.

Preferably, the V-shaped notch is made by cutting and removing a triangular piece of the front or rear portion, respectively, of the seat. According to one embodiment, the flaps of the V-shaped notches are rectilinear and straight. According to another embodiment, the flaps of the V-shaped notches are curvilinear with inner ends close together and diverging open ends.

According to another aspect of the invention, cyclist trousers are made by the preparation of a seat as described above, obtaining a seat formed with a concave region at least in the front part and preferably also in the rear part of the seat, and then by joining (for example stitching) the seat to the trousers The invention has the advantage that the seat is pre-formed with anatomical shape of the front part and, in the preferred embodiment, also of the rear part. By joining the flap of the V-notches, the corresponding region of the seat assumes and maintains a concave, anatomical shape. Hence, the anatomical design of the seat, in contact with the critical perineal region of the user, is obtained regardless of the shape of the cyclist trousers or the technique used to join the seat to the trousers. From the point of view of production, advantages are achieved in associating the seat with different models of trousers, since the seat itself is pre-formed with the desired anatomical design. Further advantages can be obtained in providing a range of different trousers for different purposes, e.g. male/female, more or less intensive use, and so on.

The features of the invention shall become clearer from the following description of preferred embodiments, with reference to the drawings given for indicating and not limiting purposes.

DETAILED DESCRIPTION OF PREFERRED EMBODIMENTS

Figure 1:
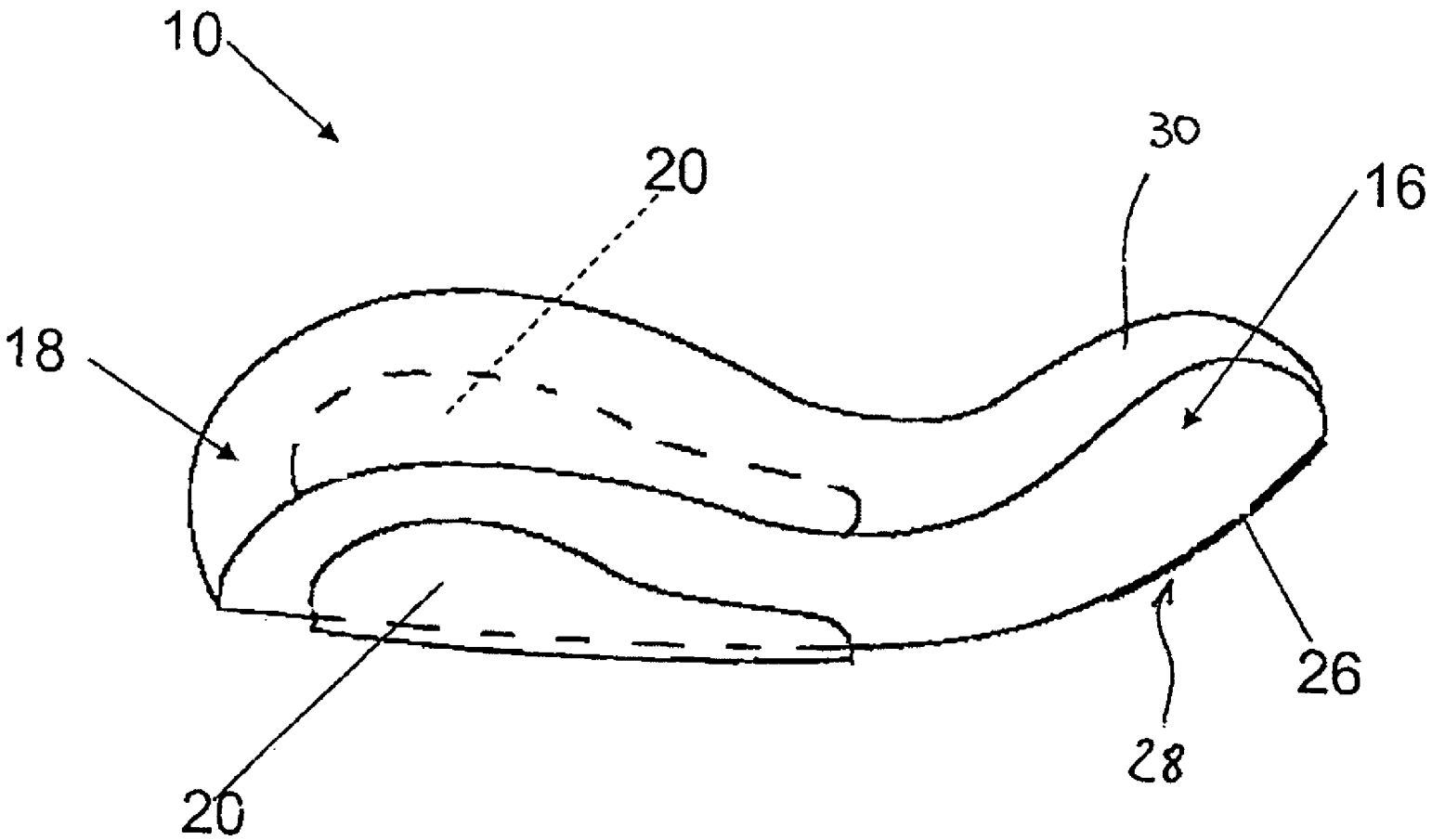
FIG. 1 is a side view of a protection seat for cyclist trousers according to one embodiment of the invention.

FIG. 1 shows a first embodiment of the invention where a protection seat 10 is provided with a front portion 16 and a rear portion 18 equipped with pads 20. The front portion 16 is formed with a concave region 30, as shown, by joining two flaps 26 of a notch previously cut in the front portion 16 forming a joint 28.

The front portion 16 is preferably made with an anatomical shape suitable for shielding the male genitals, in particular the scrotal area, and is sized and limited to front areas of the seat 10 that are not subject to the tensions that can derive from the pedaling movement.

Figures 2, 3, 4:
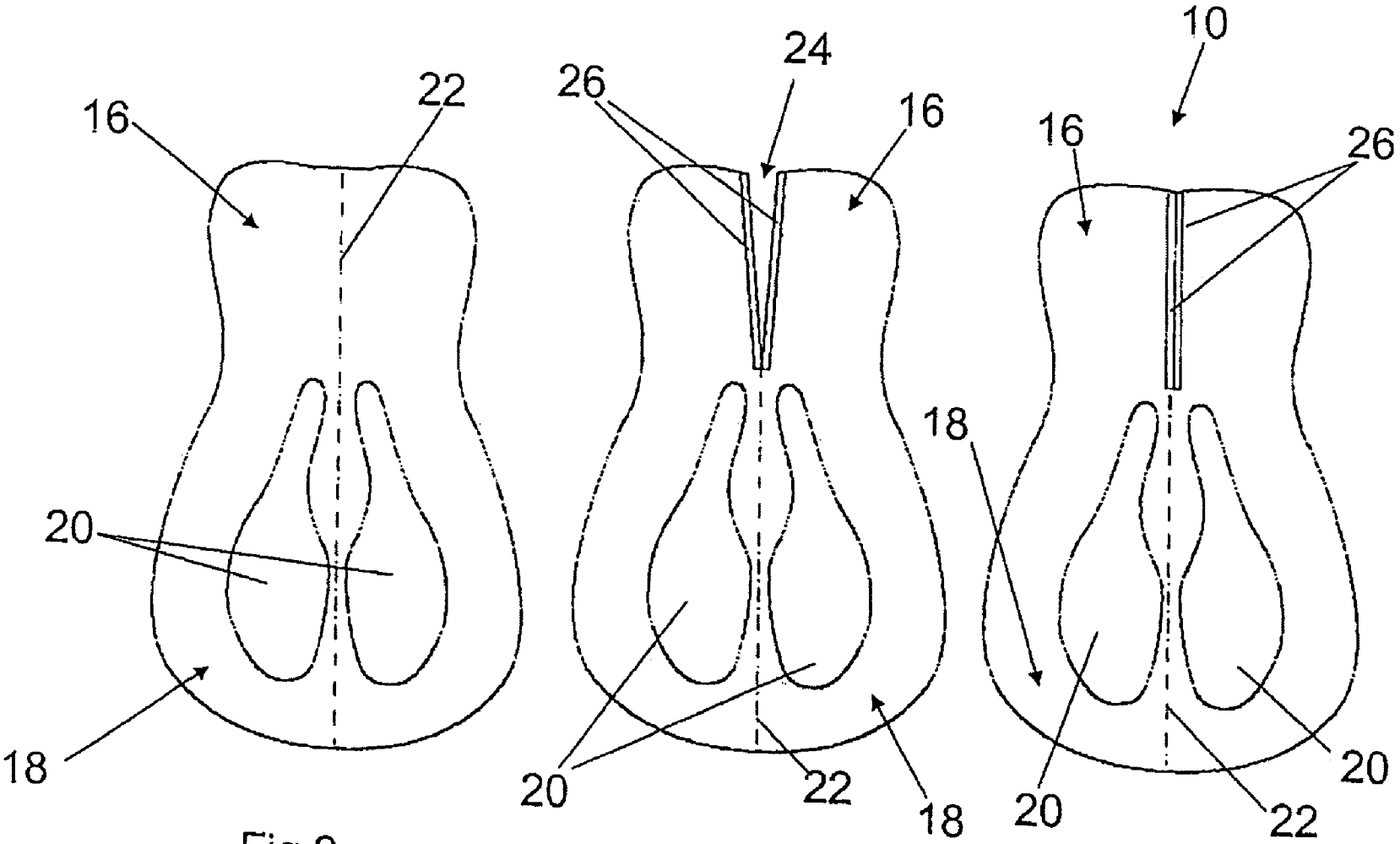
FIGS. 2 to 4 are schematic plan views from above of the protection seat of FIG. 1, in successive steps of its manufacture.

FIGS. 2 to 4 show a preferred method for manufacturing the seat 10. Said manufacturing method essentially comprises the steps of:

- shaping the seat 10 with said front portion 16 and said rear portion 18 (FIG. 2);
- making a longitudinal median notch 24, open at the end, substantially V-shaped, on said front portion 16, obtained two opposite flaps 26;
- joining at least a portion of said flaps 26, forming the joint 28 and obtaining said concave region 30 in the front portion 16.

Preferably, the method comprises a further step of associating the shaped pads 20 with the rear portion 18 of the seat, with conventional techniques, for example with stitching, heat sealing or gluing. The pads 20 can be stitched or associated in another way to the seat 10 before or after making the notch 24 and joining flaps 26. The pads 20 are preferably symmetrical with respect to a median line 22 of the seat 10.

Figure 5:
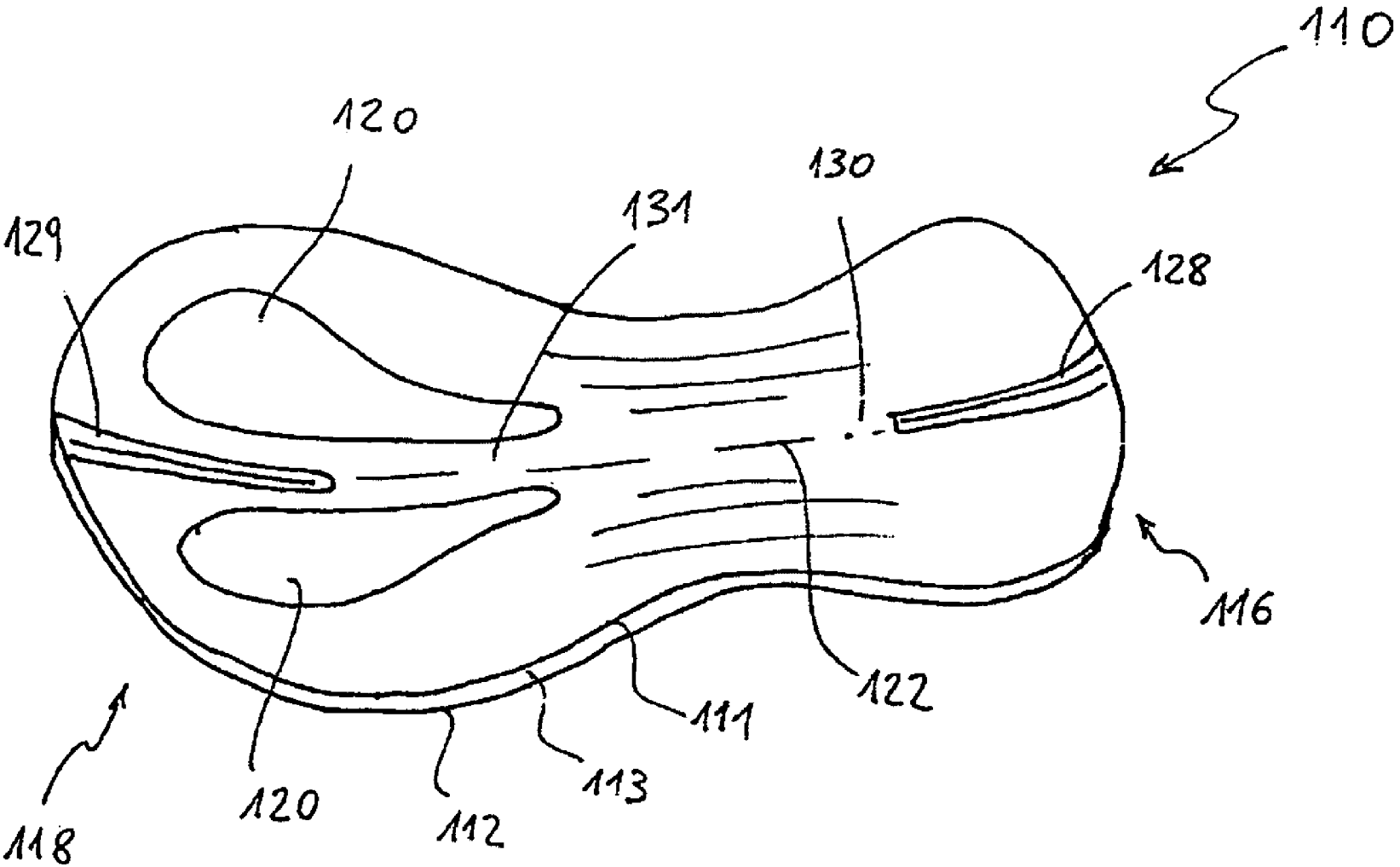
FIG. 5 is a schematic perspective view of a protection seat for cyclist trousers according to another preferred embodiment of the invention.

Referring to the further embodiment of FIG. 5, a protection seat 110 according to the invention comprises a top layer 111 and a bottom layer 112, both made from elastic fabric, natural or synthetic, with an intermediate layer 113 of soft material.

Said seat 110 has a front portion 116 and a rear portion 118 to respectively protect the front pubic area and perineal-ischiatic area of the cyclist. Said front and rear portions 116, 118 are both formed with a concave shell-shape.

As can be understood from FIG. 5, the seat 110 as a whole tends to take up a shell-shaped configuration, substantially with two depressions 130 and 131 respectively at the front and rear part, aligned along the median line 122 of the seat, with side walls that progressively rise with respect to said depressions 130, 131.

The concave shell-shape of the portions 116 and 118 is preferably obtained with longitudinal median joints 128, 129 between the flaps of respective notches made at the front and rear parts, as shall be made clearer hereafter with reference to an example.

The front portion 116 is preferably made with an anatomical shape suitable for shielding the male genitals, in particular the scrotal area, and is sized and limited to front areas of the seat 110 that are not subject to the tensions that can derive from the pedaling movement.

The rear portion 118 is equipped with a pair of shaped pads 120. Said pads 120 are preferably enantiomorphous, i.e. equally spaced and symmetrical with respect to said median longitudinal line 122 of the seat 110.

Figures 6, 7, 8:
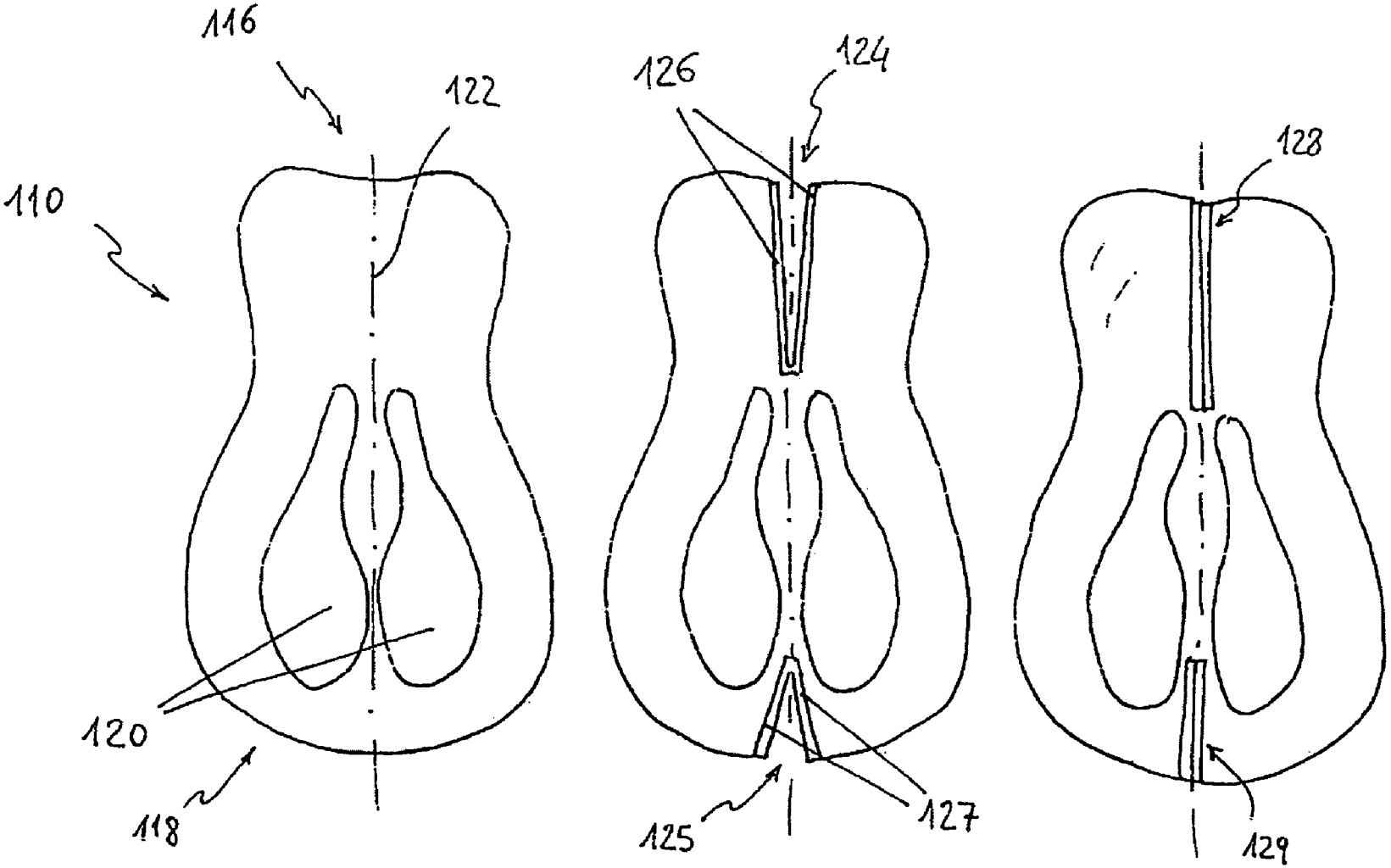
FIGS. 6, 7 and 8 are schematic plan views from above of the protection seat of FIG. 1, in successive steps of its manufacture.

FIGS. 6 to 8 schematically represent a method for manufacturing the seat 110. The manufacturing method essentially comprises the steps of:

- shaping the seat 110 with said front portion 116 and said rear portion 118 (FIG. 6);
- making a first longitudinal median notch 124, open at the end, substantially V-shaped, on said front portion 116, obtaining two opposite flaps 126, and making a second longitudinal median notch 125 open at the end, substantially V-shaped, on the rear portion 118, obtaining two further opposite flaps 127;
- joining at least a portion of the respective opposite flaps 126 and 127, obtaining respective front and rear longitudinal joints 128 and 129 thus obtaining a concave region in the front and rear portions of the seat 110.

Preferably, the method comprises a further step of associating the shaped pads 120 with the rear portion 118 of the seat 110, with conventional techniques, for example with stitching, heat sealing or gluing. The pads 120 can be stitched or associated in another way to the seat 110 irrespectively before or after making the notches 124, 125 and the joints 128, 129.

Details of the joints 128 and 129 and the manufacturing process are described below, according to preferred embodiments of the invention. The same details are applicable to the joint 28 of the seat 10 of FIG. 1.

The median longitudinal notches 124 and 125 are passing-through notches, i.e. made by cutting the layers 111 and 112 and the intermediate layer 113, removing from seat 110 a triangular fragment of material and obtaining the flaps 126, 127.

Figure 9:
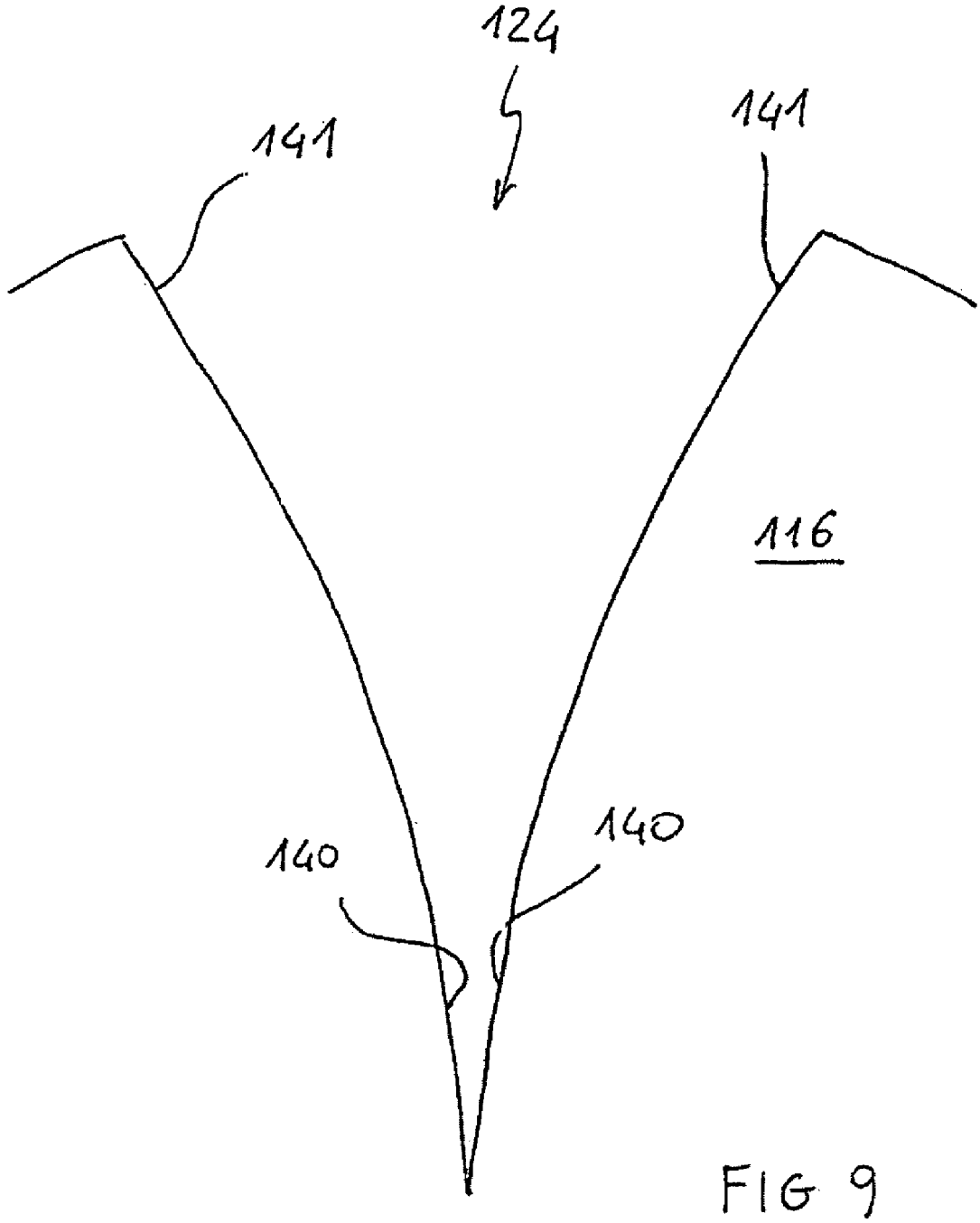
FIG. 9 is a detail of FIG. 3 showing one embodiment of the V-notches cut in the seat.

According to one embodiment, flaps 126, 127 are rectilinear and straight. According to another embodiment, flaps 126 and 127 have diverging open ends. FIG. 9 shows an embodiment where the notch 124 is obtained with inner ends 140 close together with tangent lines forming a small angle e.g. of 10-15 degrees or less, and opposite open ends 141 which diverge so that tangent lines to the open ends 141 form a larger angle for example of 60 degrees. The same is applicable to notch 125.

Preferably, the joints 128 and 129 are made along the entire extension of the respective notch, joining the flaps for their entire length.

According to a preferred aspect, length of the notches 124 and 125, and therefore of the respective joints 128, 129 is between about one quarter and about one third of the initial length of the shaped seat. For example, if the longitudinal size of the seat 110, along the line 122, is about 40 cm, preferably the front V-notch 124 is about 10-12 cm and similarly the rear V-notch 125 is about 10-12 cm. Clearly, such indications are not limiting.

The joints 128 and 129 have the effect of defining a concave region in the front part 116 and the rear part 118 of the seat 110. As a portion of material is removed when forming the notches 124, 125, the surface of the seat cannot remain plane when joining the flaps 126, 127, but is curved assuming a concave, shell shape. The joints 128 and 129 are made with conventional techniques, e.g. stitching, heat sealing or gluing.

Figure 11:
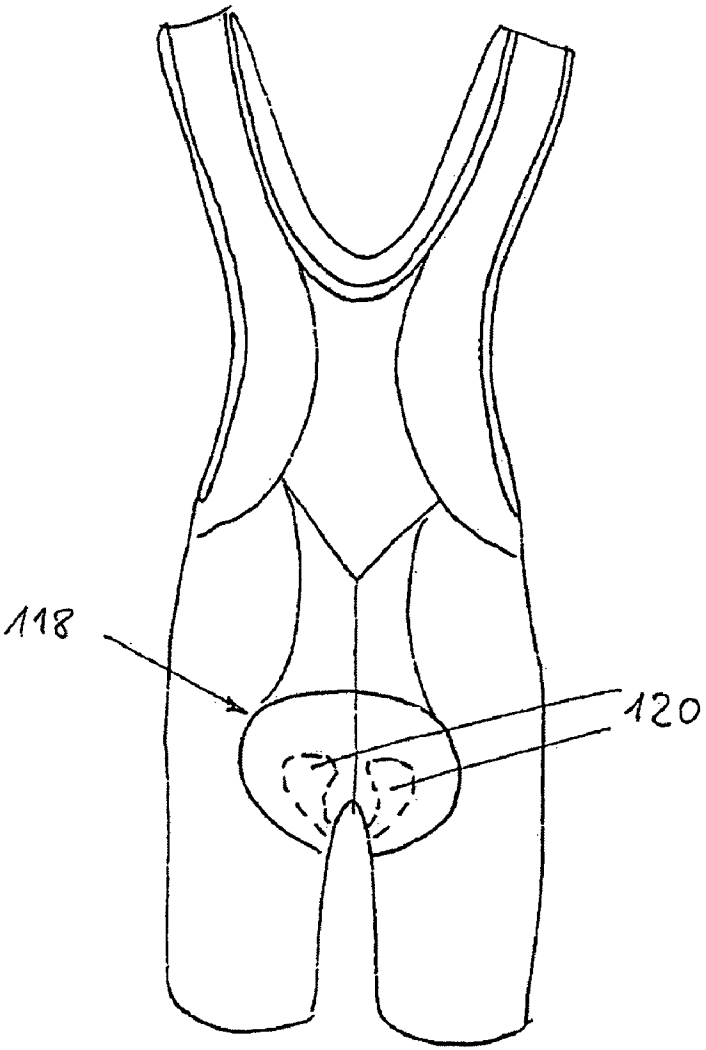
FIG. 11 is a rear view of the cyclist trousers of FIG. 5.
Figure 10:
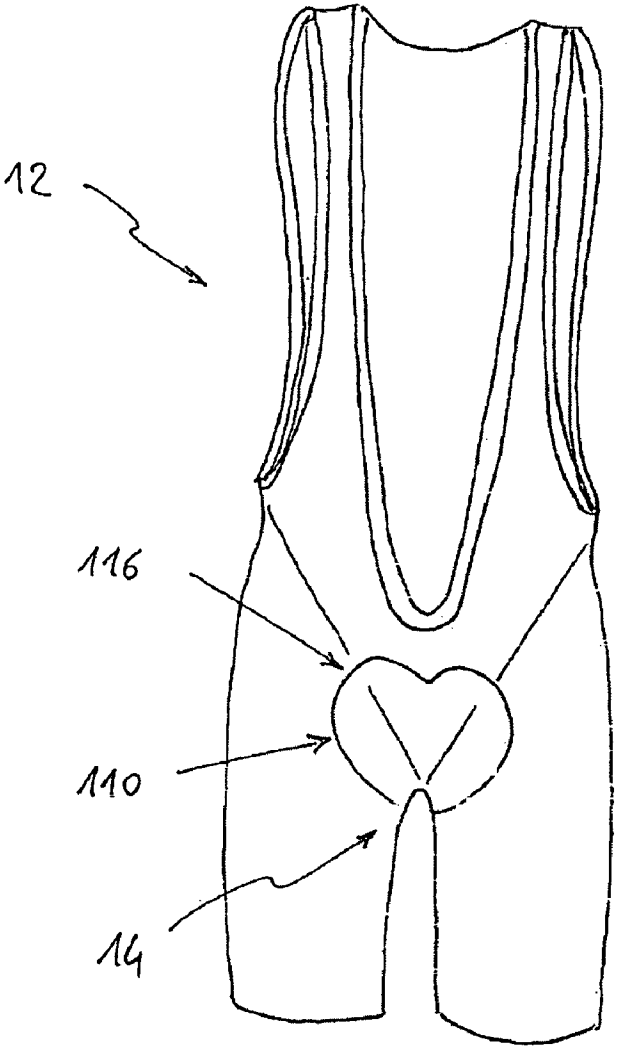
FIG. 10 is a front view of cyclist trousers equipped with the seat of FIG. 1.

FIGS. 10 and 11 show an example of a skin-tight sports garment or cyclist trousers 12 equipped with the protection seat 110. The protection, seat 110 is placed at the so-called crotch area 14 of said trousers 12. The seat 110 is associated with the trousers 12, or is formed in the trousers 12 themselves, and is intended to protect the perineal and ischiatic area of the cyclist's body, which is in contact with the bicycle saddle during use.

Similar trousers 12 can be equipped with the seat 10 of embodiment of FIG. 1.

It should be noted that the joints 128, 129 are made on the seat 110 before the same seat 110 is stitched onto the trousers 12. In other words, the seat itself, as a finished product, is preformed with the anatomical concave region in the front portion 16 or both front and rear portions 116, 118.

From the previous description it can clearly be seen that the protection seat for cyclist trousers according to the invention solves the technical problem and achieves numerous advantages, including unmatched good fit.

The shell-shaped concave region of the front portion 16 or 116 gives an improved fit in particular for male cyclists. The shell-shaped front portion, limited to the front areas of the seat that are not subject to the tensions deriving from the pedaling movement, remains substantially stationary during the use, and consequently does not compress the scrotal area, so that the trousers are particularly comfortable. A further advantage for male cyclists is that the front portion of the shell-shaped seat protects and also supports the genitals.

During the pedaling movement, the compression of the seat on the scrotal area is greatly reduced, which means absolute comfort. In practice, this is obtained by making the front portion of the seat "independent" from the rear portion, i.e. by making the portion that is in contact with the genital independent from the portion that is in contact with the buttocks: in this way, the maximum freedom of movement is ensured during pedaling.

The concave shell-shaped configuration of the rear portion further improves the skin-tightness and good fit.

Of course, a man skilled in the art can bring numerous modifications and variants, in order to satisfy specific and contingent requirements, all of which are also covered by the scope of protection of the present invention as defined by the following claims.

The invention claimed is:

1. A protection seat for the crotch area of a cyclist trousers, said seat comprising, in a single piece, a front pubic portion and a rear perineal-ischiatic portion, wherein said front pubic portion of the seat is formed with a concave shell shape; and wherein said concave shell shape is formed by a joint of a longitudinal median V-shaped notch made in said front pubic portion of the seat.

2. The seat according to claim 1, wherein said rear perineal-ischiatic portion of the seat is also formed with a concave shell shape.

3. The seat according to claim 1, wherein length of said joint is between one quarter and one third of the length of the seat.

4. The seat according to claim 2, wherein said concave shell shape is formed by joints of respective longitudinal median notches made in the front pubic portion and in the rear perineal-ischiatic portion of the seat.

5. The seat according to claim 1, wherein length of said joints is between one quarter and one third of the length of the seat.

6. The seat according to claim 1, wherein said front public portion is formed with anatomical shape suitable for shielding, protecting and supporting the male genitals.

7. The seat according to claim 1, wherein said front pubic portion has a concave shell shape that is limited to portions of the seat that are not subject to tensions due to the pedalling movement.

8. The seat according to claim 1, wherein the rear perineal-ischiatic portion is equipped with at least a pair of shaped pads, equally spaced apart and symmetrical with respect to a median longitudinal line of the seat.

9. Cyclist trousers comprising a protection seat according to claim 1.

10. A method for manufacturing a protection seat for cyclist trousers, comprising at least the steps of:

shaping the seat with a front pubic portion and a rear perineal-ischiatic portion;

making on said front pubic portion a longitudinal median V-shaped notch, open at the end, obtaining two opposite flaps;

joining at least a portion of said opposite flaps, obtaining a front longitudinal joint thus forming a shell-shaped concave region in said front pubic portion of the seat.

11. A method for manufacturing a protection seat for cyclist trousers according to claim 10, further comprising the steps of:

making on said rear perineal-ischiatic portion of the seat a further longitudinal, median V-shaped notch open at the end, obtaining two further opposite flaps;

joining at least a portion of said further opposite flaps, obtaining a rear longitudinal joint and thus forming a shell-shaped concave region in said rear perineal-ischiatic portion of the seat.

12. The method according to claim 10, wherein said V-notch is made by removing a triangular piece of material from the respective front pubic or rear perineal-ischiatic portion of the seat, obtaining rectilinear flaps.

13. The method according to claim 11, wherein said V-notches are made by removing a triangular piece of material from the respective front pubic or rear perineal-ischiatic portion of the seat, obtaining rectilinear flaps.

14. The method according to claim 10, wherein the flaps of the V-shaped notch are curvilinear with inner ends close together and diverging open ends.

15. The method according to claim 11, wherein the flaps of the V-shaped notches are curvilinear with inner ends close together and diverging open ends.

* * * * *